US009862071B2

(12) United States Patent
Feng et al.

(10) Patent No.: US 9,862,071 B2
(45) Date of Patent: Jan. 9, 2018

(54) METHOD FOR MANUFACTURING POLISHING PAD AND POLISHING PAD

(75) Inventors: Chung-Chih Feng, Kaohsiung (TW); I-Peng Yao, Kaohsiung (TW); Yung-Chang Hung, Kaohsiung (TW); Lyang-Gung Wang, Kaohsiung (TW)

(73) Assignee: SAN FANG CHEMICAL INDUSTRY CO., LTD., Kaohsiung (TW)

( * ) Notice: Subject to any disclaimer, the term of this patent is extended or adjusted under 35 U.S.C. 154(b) by 928 days.

(21) Appl. No.: 12/887,363

(22) Filed: Sep. 21, 2010

(65) Prior Publication Data

US 2011/0070814 A1 Mar. 24, 2011

(30) Foreign Application Priority Data

Sep. 22, 2009 (TW) ..... 98131972 A

(51) Int. Cl.
*C09K 3/14* (2006.01)
*B24B 37/24* (2012.01)

(52) U.S. Cl.
CPC ..... *B24B 37/24* (2013.01)

(58) Field of Classification Search
None
See application file for complete search history.

(56) References Cited

U.S. PATENT DOCUMENTS 6,477,926 B1 11/2002 Swisher et al.
6,841,480 B2 * 1/2005 Simpson ..... B24B 37/245 216/88
6,860,802 B1 3/2005 Vishwanathan et al.
2002/0069591 A1 * 6/2002 Yancey ..... 51/297
2004/0055223 A1 * 3/2004 Ono et al. ..... 51/293
2004/0166779 A1 * 8/2004 Balijepalli et al. ..... 451/41
2004/0166790 A1 * 8/2004 Balijepalli et al. ..... 451/526
(Continued)

FOREIGN PATENT DOCUMENTS

CN 2578044 Y 10/2003
CN 1464014 12/2003
(Continued)

OTHER PUBLICATIONS

Office action and search report dated Jan. 15, 2013 to the corresponding Taiwan Application No. 098131972 which cites TW 550165, TW 200932431A and CN 2578044Y.
(Continued)

*Primary Examiner* — Kaj K Olsen
*Assistant Examiner* — Ross J Christie
(74) *Attorney, Agent, or Firm* — WPAT, P.C., Intellectual Property Attorneys; Anthony King

(57) ABSTRACT

The present invention relates to a method for manufacturing a polishing pad. The method of the invention includes the steps of forming a polishing layer from a polyurethane solution has a solid content more than about 90 wt % and drying the polyurethane solution at a temperature from about 130° C. to about 170° C. The invention also provides a polishing pad manufactured by the method mentioned above. The defect of scraping the surface of the substrate to be polished due to polishing particles remaining is avoided when applying the polishing pad according to the invention, and the flatness of the substrate to be polished is raised and the defective rate is eliminated also.

15 Claims, 1 Drawing Sheet

(56) References Cited

U.S. PATENT DOCUMENTS

| | | | | |
|---|---|---|---|---|
| 2005/0101227 | A1* | 5/2005 | Balijepalli et al. | 451/41 |
| 2005/0170168 | A1* | 8/2005 | Wang et al. | 428/322.2 |
| 2005/0181190 | A1* | 8/2005 | Wang et al. | 428/209 |
| 2006/0079589 | A1* | 4/2006 | Tadokoro et al. | 521/155 |
| 2006/0148392 | A1* | 7/2006 | Ono et al. | 451/526 |
| 2006/0148393 | A1* | 7/2006 | Ono et al. | 451/526 |
| 2007/0010175 | A1* | 1/2007 | Feng et al. | 451/41 |
| 2008/0075938 | A1* | 3/2008 | Wang et al. | 428/213 |
| 2008/0095945 | A1* | 4/2008 | Wang et al. | 427/385.5 |
| 2008/0200102 | A1* | 8/2008 | Feng et al. | 51/297 |
| 2008/0305983 | A1* | 12/2008 | Smith et al. | 510/445 |
| 2009/0012230 | A1* | 1/2009 | Bedri et al. | 524/590 |
| 2010/0015341 | A1* | 1/2010 | Erdem et al. | 427/385.5 |
| 2010/0162631 | A1 | 7/2010 | Sato et al. | |

FOREIGN PATENT DOCUMENTS

| | | | | |
|---|---|---|---|---|
| CN | 101024260 | | 8/2007 | |
| CN | 101219534 | | 7/2008 | |
| CN | 101605831 | | 12/2009 | |
| JP | 10114849 | A * | 5/1998 | C08L 51/04 |
| TW | 550165 | | 9/2003 | |
| TW | 200521167 | | 7/2005 | |
| TW | 200932431 | A | 8/2009 | |
| WO | WO 2008077118 | A2 * | 6/2008 | |
| WO | WO 2009149035 | A1 * | 12/2009 | C08G 18/28 |
| WO | WO 2009149036 | A1 * | 12/2009 | C08G 18/48 |

OTHER PUBLICATIONS

English translation of cited reference CN 2578044Y.

Cited reference TW550165 corresponds to U.S. Pat. No. 6,477,926 and cited reference TW200932431A corresponds to US 2010/0162631.

Office action and search report dated Apr. 15, 2013 to the corresponding Chinese Patent Application No. 201010164026.1 which cites CN 101219534A, CN 1464014A and CN 101024260A.

English translation Office action and search report dated Apr. 15, 2013 to the corresponding Chinese Patent Application No. 201010164026.1.

English translation of CN 1464014A.

CN 101219534A corresponds to US 2008/0171493A1.

CN 101024260A corresponds to US 2007/0202780A1.

Office action and search report dated Sep. 29, 2013 to the corresponding Chinese Patent Application No. 201010164026.1 which cites TW200521167 and CN101605831.

TW200521167 corresponds to US 2005/0170168.

CN101605831A corresponds to US 2010/015341.

* cited by examiner

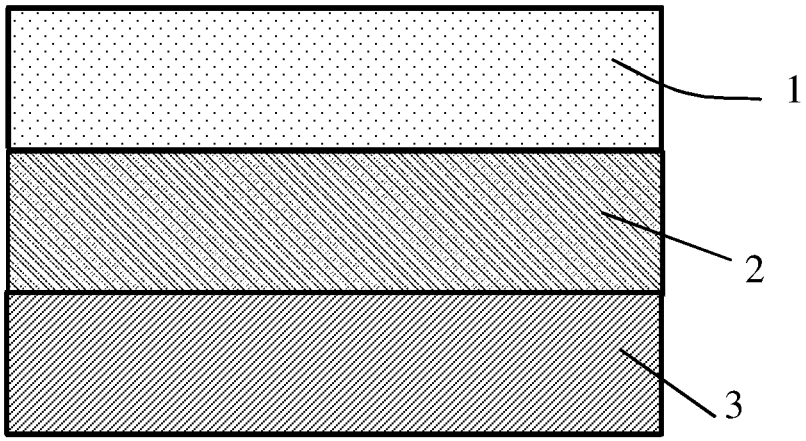
1
2
3

METHOD FOR MANUFACTURING POLISHING PAD AND POLISHING PAD

This application claims the benefit of and priority to Taiwan Patent Application No. 098131972, filed Sep. 22, 2009, the contents of which are incorporated herein by reference in its entirety.

BACKGROUND OF THE INVENTION

1. Field of the Invention

The present invention relates to a method for manufacturing a polishing pad and a polishing pad.

2. Description of the Related Art

Chemical mechanical polishing (CMP) is a procedure for planarizing the surface of a substrate with a polishing pad. CMP is generally applied in polishing lens, mirrors, substrates of liquid crystal displays, silicon wafers, and oxidation and/or metal layers on silicon wafers.

Taking silicon wafers as an example, ingots of monocrystalline silicon are sliced first. The wafers are usually lapped to make them flat for subsequently chemical etching. A polishing process is required after the etching process. During the polishing process, a polishing pad together with slurry reacts chemically with the silicon atoms on the surface of the wafer to make the reacted surface softer than the underlying silicon. Furthermore, the reacted surface is continually wiped away causing fresh silicon to be exposed to the slurry and the polishing pad.

A conventional polishing pad is disclosed in U.S. Pat. No. 6,860,802. A thermosetting mixture is poured into a cylindrical mold. Then, the thermosetting mixture is cured or heated to become a block. The block is cooled and skived into a polishing pad. The thermosetting mixture according to the conventional polishing pad usually has a low solid content, such as about 25 to 35 wt %, so that the thermoset fails to distribute evenly. When applying such conventional polishing pad in a chemical mechanical polishing procedure, the flatness of the substrate to be polished is not satisfactory, and the uniformity is raised. Therefore, the polishing particles in the slurry are remained on the surface of the substrate to be polished, and the surface of the substrate to be polished is scraped. If applying the conventional polishing pad in the manufacture of wafer, the scrapes on the surface of wafer affect the stability, and the subsequent procedures of litho or photo, development and etching. When stacking micro integrated circuits, the stability is diminished and the defective rate is raised. Thereby, the cost of manufacture is raised. Furthermore, when manufacturing the conventional polishing pad, volatile organic compounds are produced, and pollution is yielded.

SUMMARY OF THE INVENTION

The method according to the invention uses a high-molecular material with low or even no solvent, and the pollution yielded in the manufacture is diminished. The high-molecular material with low or even no solvent comprises an aqueous high-molecular material, a high-molecular material with a high solid content or a high-molecular material without solvent.

One object of the present invention is to provide a method for manufacturing a polishing pad, the polishing pad comprising a polishing layer and the polishing layer is prepared according to a process comprising forming a polishing layer from a polyurethane solution having a solid content more than about 90 wt %; and drying the polyurethane solution at about 130° C. to about 170° C.

Another object of the present invention is to provide a polishing pad manufactured by the method mentioned above.

The defect of scraping the surface of the substrate to be polished due to polishing particles remaining is avoided when applying the polishing pad according to the invention, and the flatness of the substrate to be polished is raised and the defective rate is eliminated also.

BRIEF DESCRIPTION OF DRAWINGS

FIG. 1 is a cross-sectional view of the polishing pad in one embodiment of the invention.

DETAILED DESCRIPTION OF THE INVENTION

The present invention is to provide a method for manufacturing a polishing pad, the polishing pad comprising a polishing layer and the polishing layer is prepared according to a process comprising:

(a) forming a polishing layer 1 (referring to FIG. 1) from a polyurethane solution having a solid content more than about 90 wt %; and (b) drying the polyurethane solution at about 130° C. to about 170° C.

The polyurethane solution with the high solid content is dried at a high temperature in the method according to the invention. As the result, the net-like molecular bonds break and the concentration of the polymer molecules is lowed, that benefits the even distribution in the polishing pad. The density is 0.01 to 0.5 g/cm$^3$. If skived into a sheet, the polishing surface is more smooth and the efficiency is improved thereby.

Preferably, the polyurethane solution with the high solid content is provided at about 60° C. to about 120° C. The relative low temperature is suitable for the drying and curing step later, and improves the breaking of the net-like molecular bonds at a high temperature.

In one preferred embodiment of the invention, the method further comprises a curing step that comprises cooling and curing the high-temperature dried polishing layer at about 30° C. to about 50° C.

In one preferred embodiment of the invention, the method further comprises providing a base material before the step (a), and the polyurethane is attached on the base material. Preferably, the polyurethane solution is attached by impregnating or coating. Preferably, the base material is a non-woven fabric, and more preferably, the base material is a rolled non-woven fabric. The rolled nonwoven fabric can be used in a roll to roll way that improves batch uniformity in comparison with a conventional method of producing a single polishing pad involving molding or casting.

In another aspect, the viscosity of the polyurethane solution is one of the important parameters in the method according to the invention. Preferably, the method comprises impregnating the base material with the polyurethane solution, and the polyurethane solution has a viscosity from about 1000 cps to about 9000 cps. In another aspect, the method comprises coating the polyurethane solution on the base material, and the polyurethane solution has a viscosity from about 8000 cps to about 12000 cps.

As used herein, "non-woven fabric" refers to a manufactured sheet, web or mat of directionally or randomly orientated fibers, bonded by friction, and/or cohesion and/or adhesion, excluding paper and products which are woven, knitted, tufted, stitch-bonded incorporating binding yarns or filaments, or felted by wet-milling, whether or not additionally needled. The fibers may be of natural or man-made origin. They may be staple or continuous filaments or be formed in situ. Depending on the manner of forming the web, the nonwoven fabric usually comprises a composite nonwoven fabric, a needle-punched nonwoven fabric, a melt-blown nonwoven fabric, a spunbonded nonwoven fabric, a dry-laid nonwoven fabric, a wet-laid nonwoven fabric, a stitch bonded nonwoven fabric, or a spunlace nonwoven fabric. Compared to woven fabric, non-woven fabric has a better material property. Preferably, the non-woven fabric comprises a fiber.

As used herein, the term "fiber" refers to a single fiber or composite fibers, preferably composite fibers. The fiber is selected in accordance with the substrate to be polished. The fibers of the surface of the base material provide protrusions for polishing and also provide a scaffold allowing polyurethane of the polishing layer to be deposed in the space defined by the scaffold. Artisans skilled in this field can choose suitable kinds of fibers and coordinate the polyurethane with the fibers according to the disclosure of the specification. Preferably, the fiber is made of at least one material selected from the group consisting of polyamide, terephthalamide, polyester, polymethyl methacrylate, polyethylene terephthalate, polyacrylonitrile, and mixtures thereof.

In one embodiment of the invention, the base material further comprises elastomer. As used herein, the term "elastomer," also known as "elastic polymer," refers to a type of polymer that exhibits rubber-like qualities. When polishing, the elastomer serves as a good buffer to avoid scraping the surface of the substrate to be polished. In one preferred embodiment of the invention, the elastomers are foam resins. As used herein, the term "foam resin" refers to a material containing a thermoplastic resin and a thermodecomposing foaming agent. Preferably, the elastomers comprises at least one selected from the group consisting of polyurethane, polyolefin, polycarbonate, polyvinyl alcohol, nylon, elastic rubber, polystyrene, polyaromatic molecules, fluorine-containing polymer, polyidmide, cross-linked polyurethane, cross-linked polyolefin, polyether, polyester, polyacrylate, elastic polyethylene, polytetrafluoroethylene, poly (ethylene terephthalate), polyaromatic amide, polyarylalkene, polymethyl methacrylate, a copolymer thereof, a block copolymer thereof, a mixture thereof, and a blend thereof.

In one preferred embodiment of the invention, the method further comprises a step of skiving the polishing layer into a sheet to benefit the later applications.

In one preferred embodiment of the invention, the method further comprises a step of polishing the surface of the polishing layer. If applying the polishing step along with the skiving step, the polishing step is preferably applied after skiving. For example, the polishing can be accomplished using a sand blast. The conditions for mechanical polishing are well known to artisans skilled in this field.

In one embodiment of the invention, the method further comprises a step of applying a paste on the polishing layer for adhering the polishing pad onto a polishing machine. Artisans skilled in this field can choose suitable kinds of paste according to the disclosure of the specification.

In one preferred embodiment of the invention, the paste is pressure sensitive adhesive or polyurethane. As used herein, the "pressure sensitive adhesive" comprises a carrier film and adhesive on an upper side and a lower side of the carrier film. Preferably, the material of the carrier film is selected from the group consisting of polyethylene terephthalate, polypropylene and polyethylene.

Preferably, the method further comprises providing a membrane with low permeability 3 (referring to FIG. 1) below the paste 2 (referring to FIG. 1), and the paste is on the upper surface of the membrane with low permeability. As used herein, the term "a membrane with low permeability" refers to a membrane or film that substantially prevents the paste on the upper surface of the membrane with low permeability according to the invention from permeating to the lower surface of the membrane with low permeability. Preferably, the material of the membrane with low permeability is selected from the group consisting of polyethylene terephthalate, polypropylene, polycarbonate, and polyethylene. Furthermore, the polypropylene is oriented polypropylene.

In one another preferred embodiment of the invention, the method further comprises forming an adhesive layer on a lower surface of the membrane with low permeability. Preferably, the adhesive layer is pressure sensitive adhesive or polyurethane.

In still another preferred embodiment of the invention, the method further comprising forming at least one groove on the surface of the polishing layer. Artisans skilled in this field can choose suitable manner of groove forming according to the disclosure of the specification, such as laser process. The groove helps the flow of slurry in the polishing procedure, and preferably, the ratio of the distance between the grooves to the width of the groove is 1 to 0.05.

The present invention also provides a polishing pad manufactured by the method mentioned above.

Polishing generally refers to a wear control for a preliminary coarse surface in the process of chemical mechanical polishing, which makes the slurry containing fine particles evenly dispersed on the upper surface of a polishing pad, and at the same time places a substrate against the polishing pad and then rubs the substrate repeatedly with a regular motion. A polishing device usually includes a lower base plate, a carrier film, a substrate, an upper base plate, a polishing pad and slurry. The carrier film is adhered to the lower base plate through an adhesive layer and is used for carrying and mounting the substrate. The polishing pad is mounted on the upper base plate.

The operation mode of the polishing device is as follows. First, the substrate is mounted on the carrier film, and then both the upper and lower base plates are rotated and the upper base plate is simultaneously moved downward, such that the polishing pad contacts the surface of the substrate, and a polishing operation for the substrate may be performed by continuously supplementing the slurry and using the effect of the polishing pad.

The following Examples are given for the purpose of illustration only and are not intended to limit the scope of the present invention.

EXAMPLE

A non-woven fabric comprising polyethylene terephthalate and nylon of 2.6 mm is used as a base material. At the room temperature, a polyurethane with a solid content of about 95% and propylene glycol mono-methyl ether acetate solvent is evenly coated on the surface of the non-woven fabric, and wherein the viscosity of the polyurethane is from about 10000 to about 11000 cps. The sample is heated at 160° C. for 20 min and cooled to the room temperature.

The sample is skived to a sheet of about 1.2±0.1 mm and polished to about 1.1±0.1 mm.

The polished sheet is applied with an acrylic pressure sensitive adhesive under the polishing layer and forming grooves with a laser process.

Comparative Example

The method for manufacturing a polishing pad in the comparative example is similar to the method in the example as mentioned above, except using a polyurethane solution with a low solid content of 25 to 35 wt %.

The polishing pads in the example and comparative example are used for polishing a wafer with IPEC776 machine and W-2000 (Cabot) cream colored slurry suspension containing 5 to 6 wt % $SiO_2$ and pH 2.2 to 2.5. The polishing conditions: rotation rate of a upper base plate: 20 to 25 rpm; rotation rate of a lower base plate 300 rpm to 500 rpm; down force: 3.7 to 4.0 psi; flow rate of slurry: 100 to 160 M/min. The polishing result is shown in Table 1.

TABLE 1

| | Comparative example | Example |
|---|---|---|
| Metal Removal Rate | 2844.33 | 1864.91 |
| Uniformity | 19.45 | 15.54 |
| Polishing particles | 794 | 48 |

The unit of the metal removal rate is Å, and detected with a four-point probe.

The polishing particles are detected by light-scanning.

The defect of scraping the surface of the substrate to be polished due to polishing particles remaining is avoided when applying the polishing pad according to the invention, and the flatness of the substrate to be polished is raised and the defective rate is eliminated also.

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

What is claimed is:

1. A method for manufacturing a polishing pad, the polishing pad comprising a polishing layer, the method comprising:

(a) forming the polishing layer, comprising:

(i) providing a base material, wherein the base material comprises a non-woven fabric and elastomer, and the elastomer is foam resins;

(ii) impregnating a polyurethane solution having a solid content more than about 90 wt % and a viscosity from about 1000 cps to about 9000 cps on the base material, or coating a polyurethane solution having a solid content more than about 90 wt % and a viscosity from about 8000 cps to about 12000 cps on the base material, and the polyurethane is attached on the base material;

(iii) drying the polyurethane solution at about 130° C. to about 170° C.; and (iv) curing the dried polishing layer at about 30° C. to about 50° C.;

(b) applying a paste on the polishing layer; and (c) providing a membrane with low permeability below the paste, and the paste is on the upper surface of the membrane with low permeability.

2. The method according to claim 1, wherein the polyurethane solution in the step (ii) is provided at about 60° C. to about 120° C.

3. The method according to claim 1, wherein the non-woven fabric comprises a fiber selected from the group consisting of a single fiber and a composite fiber.

4. The method according to claim 3, wherein the fiber is made of at least one material selected from the group consisting of polyamide, terephthalamide, polyester, polymethyl methacrylate, polyethylene terephthalate, polyacrylonitrile, and mixtures thereof.

5. The method according to claim 1, wherein the elastomer comprises at least one selected from the group consisting of polyurethane, polyolefin, polycarbonate, polyvinyl alcohol, nylon, elastic rubber, polystyrene, polyaromatic molecules, fluorine-containing polymer, polyidmide, cross-linked polyurethane, cross-linked polyolefin, polyether, polyester, polyacrylate, elastic polyethylene, polytetrafluoroethylene, poly(ethylene terephthalate), polyaromatic amide, polyarylalkene, polymethyl methacrylate, a copolymer thereof, a block copolymer thereof, a mixture thereof, and a blend thereof.

6. The method according to claim 1 further comprising a step of skiving the polishing layer into a sheet.

7. The method according to claim 1 further comprising a step of polishing a surface of the polishing layer.

8. The method according to claim 1, wherein the paste is pressure sensitive adhesive or polyurethane.

9. The method according to claim 1, wherein the material of the membrane with low permeability is selected from the group consisting of polyethylene terephthalate, polypropylene, polycarbonate, and polyethylene.

10. The method according to claim 9 further comprising forming an adhesive layer on a lower surface of the membrane with low permeability.

11. The method according to claim 10, wherein the adhesive layer is pressure sensitive adhesive or polyurethane.

12. The method according to claim 1, further comprising forming a plurality of grooves on a surface of the polishing layer, wherein a ratio of a distance between the grooves to a width of the groove is 1 to 0.05.

13. A polishing pad manufactured by the method according to claim 1.

14. The method according to claim 1, wherein a porosity of the polyurethane in the cured polishing layer is about 0.01 $g/cm^3$ to about 0.5 $g/cm^3$.

15. The method according to claim 12, wherein a porosity of the polyurethane in the cured polishing layer is about 0.01 $g/cm^3$ to about 0.5 $g/cm^3$.

* * * * *